US007828166B1

(12) United States Patent
Sprick

(10) Patent No.: US 7,828,166 B1
(45) Date of Patent: Nov. 9, 2010

(54) DISPENSING CLOSURE WITH CHILD RESISTANT FEATURE

(75) Inventor: William Douglas Sprick, Evansville, IN (US)

(73) Assignee: Rexam Closures and Containers Inc., Evansville, IN (US)

( * ) Notice: Subject to any disclaimer, the term of this patent is extended or adjusted under 35 U.S.C. 154(b) by 582 days.

(21) Appl. No.: 11/381,407

(22) Filed: May 3, 2006

(51) Int. Cl.

| | |
|---|---|
| ***B65D 55/02*** | (2006.01) |
| ***B65D 50/08*** | (2006.01) |
| ***B65D 51/16*** | (2006.01) |
| ***B67D 7/22*** | (2010.01) |
| ***B67D 3/00*** | (2010.01) |
| ***B67D 7/06*** | (2010.01) |

(52) U.S. Cl. ..... 215/209; 215/221; 215/216; 222/48; 222/521; 220/203.04; 220/203.05; 220/203.06

(58) Field of Classification Search ..... 215/221, 215/209, 216, 217, 218; 220/203.06, 203.04; 222/48, 521

See application file for complete search history.

(56) References Cited

U.S. PATENT DOCUMENTS

| | | | | |
|---|---|---|---|---|
| 3,376,991 | A | 4/1968 | Deaver | |
| 3,406,880 | A | 10/1968 | Stull | |
| 3,407,967 | A | 10/1968 | Stull | |
| 3,675,804 | A | 7/1972 | Micalief | |
| 3,917,097 | A * | 11/1975 | Uhlig | 215/216 |
| 3,941,268 | A | 3/1976 | Owens et al. | |
| 4,358,031 | A * | 11/1982 | Lohrman | 222/153.14 |
| 4,436,211 | A | 3/1984 | Gach | |
| 4,756,435 | A | 7/1988 | Schick et al. | |
| 4,867,354 | A | 9/1989 | Schreiber | |
| 5,038,967 | A * | 8/1991 | Braun | 222/519 |
| 5,186,369 | A | 2/1993 | Aguirrezabal | |
| 5,328,130 | A | 7/1994 | Gilman et al. | |
| 5,377,873 | A | 1/1995 | Minnette | |
| 5,551,582 | A * | 9/1996 | Robinson | 215/216 |
| 5,671,853 | A | 9/1997 | Herr | |
| 5,687,863 | A | 11/1997 | Kusz | |
| 5,692,628 | A | 12/1997 | Montgomery et al. | |
| 5,829,609 | A | 11/1998 | Beck | |
| 5,836,466 | A | 11/1998 | Briere et al. | |
| 5,908,125 | A | 6/1999 | Opresco | |
| 5,915,576 | A | 6/1999 | Robinson | |
| 6,095,382 | A | 8/2000 | Gross | |
| 6,152,315 | A * | 11/2000 | Montgomery | 215/216 |
| 6,299,038 | B1 | 10/2001 | Schmeisser et al. | |
| 6,378,713 | B2 | 4/2002 | Montgomery | |
| 6,543,650 | B1 * | 4/2003 | Sprick et al. | 222/153.14 |
| 2005/0040190 | A1 | 2/2005 | Stoneberg et al. | |

* cited by examiner

*Primary Examiner*—Anthony Stashick
*Assistant Examiner*—Andrew T Kirsch
(74) *Attorney, Agent, or Firm*—Chad D. Bruggeman; John F. Salazar; Middleton Reutlinger

(57) ABSTRACT

A dispenser closure is provided having an upper wall portion with at least one opening therein and having a thread depending from an inner annular surface thereof. A lower wall portion of the closure has at least two lugs depending from a lower inner annular surface thereof having a configuration and size to cooperate with at least one stop lock depending from a container neck and at least one of the cooperating closure lugs does not cooperate with the cooperating stop lock when the lower wall portion is deformed by a squeezing force.

20 Claims, 11 Drawing Sheets

DISPENSING CLOSURE WITH CHILD RESISTANT FEATURE

CROSS-REFERENCE TO RELATED APPLICATIONS

Not applicable.

STATEMENT REGARDING FEDERALLY SPONSORED RESEARCH OR DEVELOPMENT

Not applicable.

FIELD OF INVENTION

The present invention relates generally to dispenser closures. More particularly, the present invention relates to threadably movable dispenser closures with a child resistant feature.

BACKGROUND OF THE INVENTION

Dispenser closures that open by the axial movement of a closure along a container neck are generally known in the art. Such a closure commonly includes a closure portion that is threadably attached to the neck of a container in such a way that the closure may be threadably moved from a closed position to an open position so as to access the contents of the container. The closure of this type of closure commonly has a limited range of rotation, so that the closure may remain affixed to the container even while in the open position (i.e. non-removable). Typically, these closures do not have a child resistant feature.

SUMMARY OF THE INVENTION

The present invention comprises a non-removable dispensing closure having a child resistant feature. Additionally, the present invention provides a dispenser closure having a stopping mechanism which limits the range of rotation of the closure about a container neck. The dispensing closure includes a first side wall that is threadably attached to a container neck and has a lower portion on the first or a second side wall with at least two inward depending lugs. A container neck to which the closure cooperates includes a neck portion with an opening therein, at least one thread and at least one lug thereon. The lower portion of a closure side wall has at least two lugs spaced about a lower inner annular surface, preferably at about 90° from each other. The orientation of the lugs on the closure and container are such that when the closure is sealed on the container a first closure lug becomes adjacent a container stop lock or lug preventing or increasing the resistance to a removal rotation of the closure on the container neck providing a child resistant feature. This first closure lug is sized to not contact the stop lock when the lower wall portion of the closure is deformed by a squeezing force. A second closure lug on the lower portion of the closure side wall becomes adjacent the stop lock when the closure reaches an open position on the container functioning as an off stop. The container neck may have two stop locks, preferably spaced at about 180° from each other. In such an embodiment, it is preferable for the container to have four lugs spaced about the annular surface at about 90° intervals where two adjacent lugs cooperate with a single stop lock on the container to provide a child resistant feature and an off stop feature. Additionally, these lugs may be on the inner annular surface of a single or double wall closure. In any of the embodiments described herein or known by one having ordinary skill in the art upon reading this disclosure, the closure is spaced about the container neck allowing a squeezing force placed on a lower portion of a side wall of the closure to deform the lower wall portion, preferably transforming a circular configuration to an oval configuration, separating the closure lug(s) functioning as child resistant lug(s) from the container stop lock (s) or lug(s). Thus, a removal rotation of the closure about the container may be performed. As the removal rotation continues, at least one closure lug acting as a stop lug encounters a container stop lock, thus stopping or resisting removal of the closure from the container neck. These configurations provide a child resistant feature in a dispensing closure.

BRIEF DESCRIPTION OF THE DRAWINGS

Reference to the figures discloses several embodiments of the present invention and is not to be interpreted as limiting the scope of the present invention.

DETAILED DESCRIPTION OF THE PREFERRED EMBODIMENTS

The following detailed description is given primarily for clearness of understanding and no unnecessary limitations are to be understood there from as modifications will become obvious to those skilled in the art upon reading the disclosure and may be made without departing from the spirit of the invention and scope of the appended claims.

As shown in the FIGS. 1-11, a closure of the present invention is provided having child resistant and dispensing features with a stopping mechanism which facilitates the dispensing of the contents of a tube, bottle or similar container, but inhibits removal of the closure from the container. Closures of the present invention may be formed of any material known in the art, such as polypropylene and polyethylene or other polymeric materials.

Figure 1:
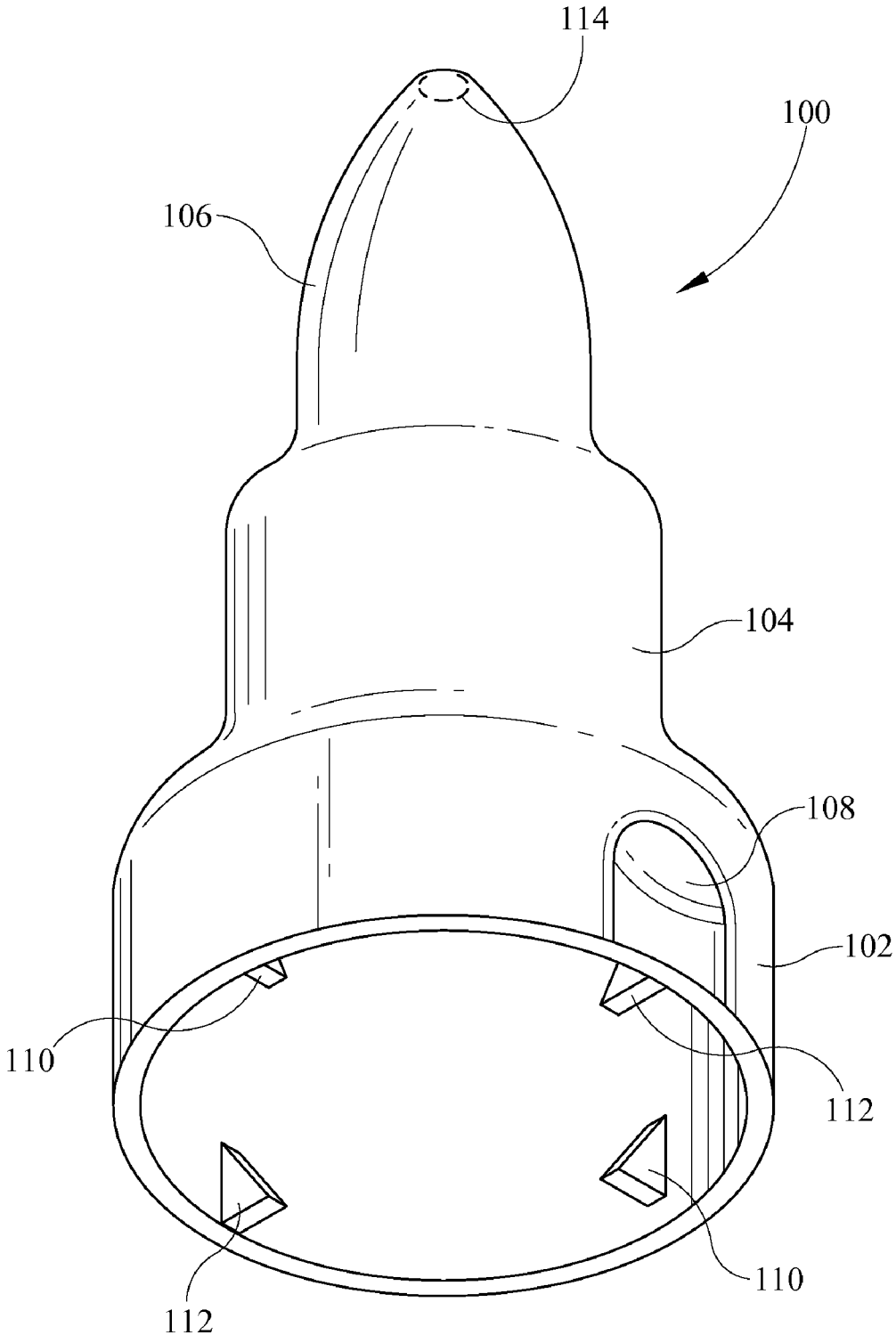
FIG. 1 is a perspective view of a preferred embodiment of the closure of the present invention showing the orientation of the closure lugs.
Figure 2:
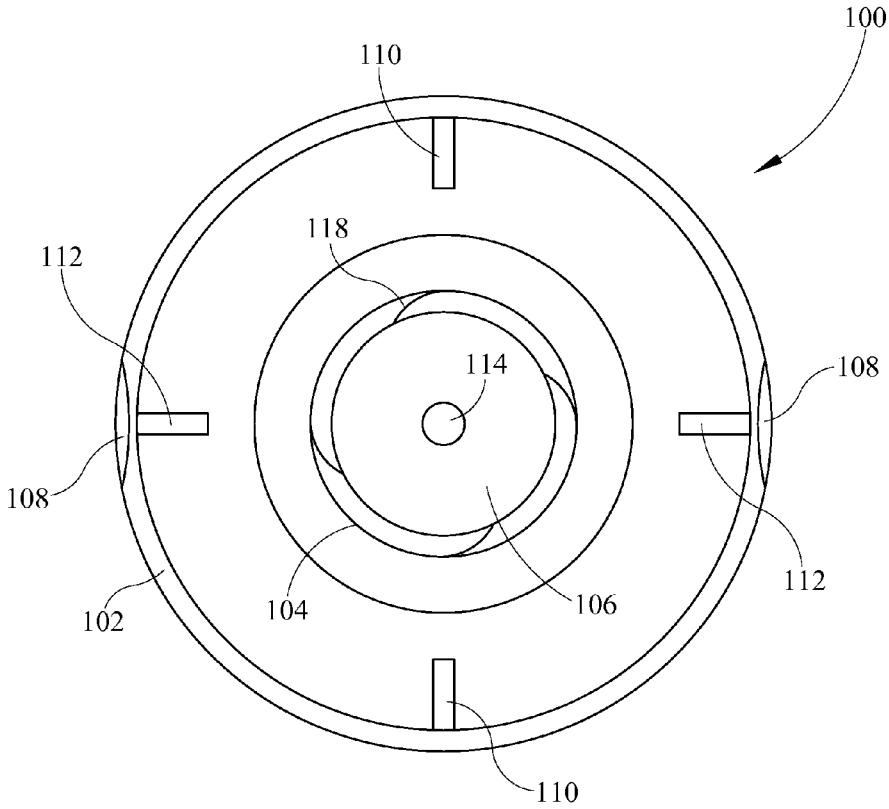
FIG. 2 is a bottom view of the closure of the closure of FIG. 1.

As shown in FIG. 1, closure 100 has closure lugs 112 and 110 depending from a lower portion 102 of inner annular surface of the side wall. In this embodiment, closure lugs 110 serve as child resistant lugs and closure lugs 112 serve as rotational stop lugs. Rotational stop lugs 112 are more proximate a bottom edge of lower portion 102. However, it is to be understood that both child resistant lugs 110 and rotational stop lugs 112 could all be proximate a bottom edge of lower portion 102 or an equidistance from a bottom edge of lower portion 102 and still function as intended and thus are embodiments of the present invention. On an external annular surface of lower portion 102 are squeeze guides 108 substantially opposite stop lugs 112. Squeeze guides 108 are preferably in the form of an indentation in the external annular surface of lower portion 102 and may optionally have a gripping contour. Upper portion 106 has opening 114. FIG. 2 is a bottom view of closure 100 showing child resistant lugs 110 spaced about the inner annular surface of lower portion 102 at about 180° intervals and the two rotational stop lugs 112 spaced about the inner annular surface of lower portion 102 at about 90° from each of the child resistant lugs 110. Middle portion 104 has helical thread 118 depending from an inner annular surface thereof. Opening 114 is centrally oriented within upper portion 106.

Figure 3:
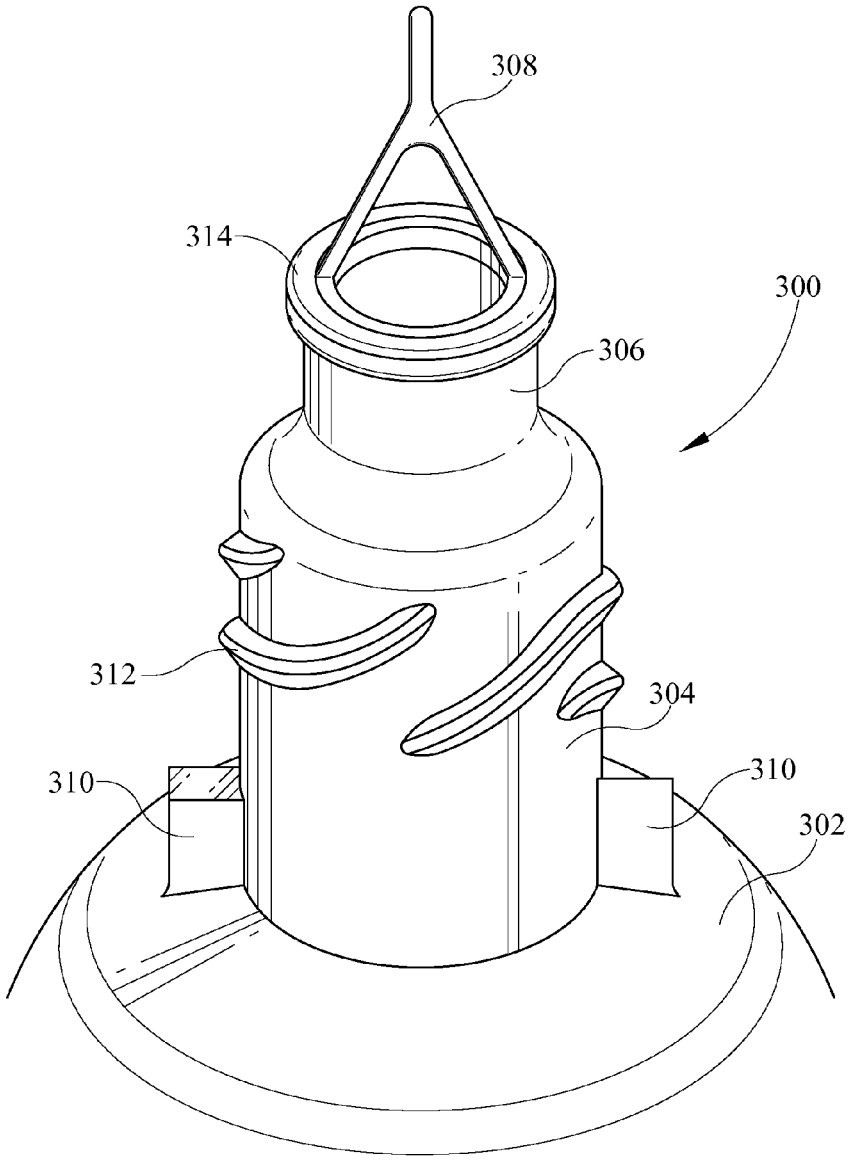
FIG. 3 is a perspective view of a container neck designed to cooperate with the closure of FIG. 1.

FIG. 3 shows dispensing container 300 having a design to cooperate with closure 100. Dispensing container 300 has a pair of stop locks 310 spaced about 180° apart and depending from container body 302 and the bottom of lower container neck portion 304 and positioned so that child resistant lugs 110 are adjacent a locking side of child resistant lugs 110 when in a sealing position. In this embodiment stop locks 310 are axially orientated and have a sloped top wall allowing child resistant lugs 110 to pass over when closure 100 nears a sealing position on container 300. Lower container neck portion 304 has helical thread 312 depending from an outer annular surface. Upper neck portion 306 has a central opening in the top circumscribed with sealing bead 314. Sealing post 308 depends upward from the central opening in upper neck portion 306. Preferably, sealing post 308 has an inverse "Y" configuration depending from a ring wherein it is retained within the central opening in upper neck portion 306 when pushed therein.

Figure 4:
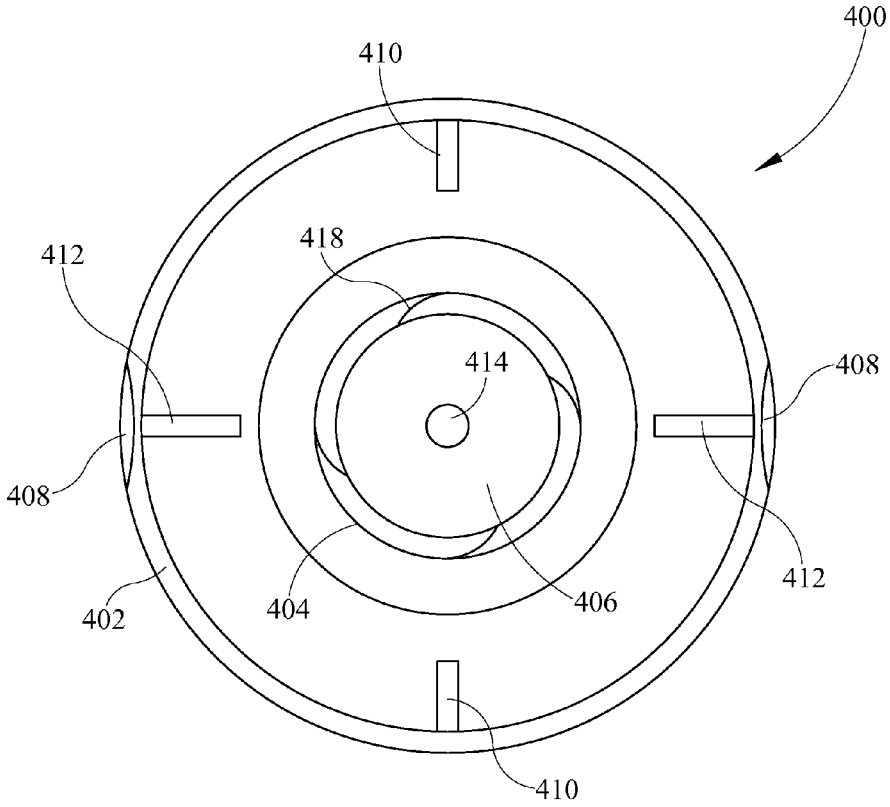
FIG. 4 is a bottom view of an alternative embodiment of the closure of the present invention.

FIG. 4 shows closure 400 having pronounced stop lugs 412. In this embodiment, child resistant lugs 410 are spaced about the inner annular surface of lower portion 402 at about 180° intervals and the two rotational stop lugs 412 are spaced about the inner annular surface of lower portion 402 at about 90° from each of the child resistant lugs 410. Rotational stop lugs 412 depend further from the inner annular surface of lower portion 402 than child resistant lugs 410 since they need not bypass stop locks on a container neck. Middle portion 404 has helical thread 418 depending from an inner annular surface thereof. Opening 414 is centrally oriented within upper portion 406.

Figure 5:
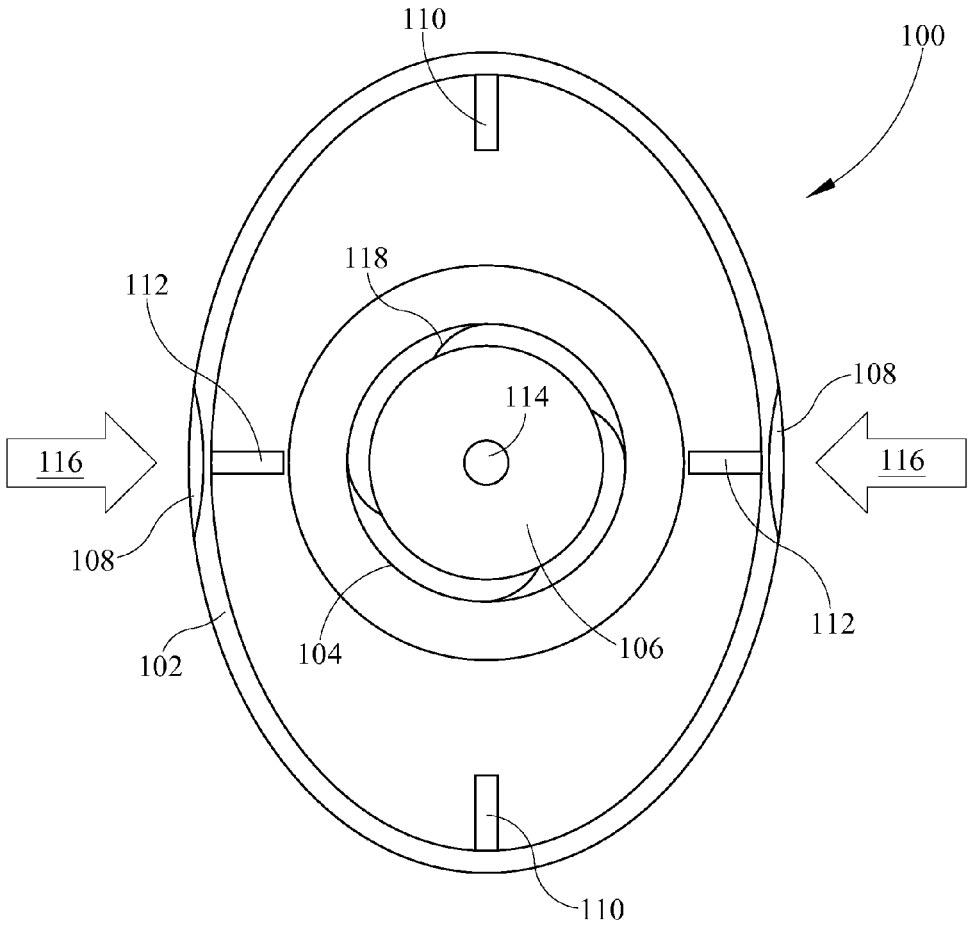
FIG. 5 is a bottom view of the closure of the closure of FIG. 1 in a child resistant release condition.

FIG. 5 shows closure 100 in a child resistant lug 110 releasing position. Closure 100 has child resistant lugs 110 spaced about the inner annular surface of lower portion 102 at about 180° intervals and the two rotational stop lugs 112 spaced about the inner annular surface of lower portion 102 at about 90° from each of the child resistant lugs 110. On an external annular surface of lower portion 102 are squeeze guides 108 substantially opposite stop lugs 112. Squeeze guides 108 are depressed with a force 116. Force 116 deforms lower portion 102 into an oval configuration wherein child resistant lugs 110 are radially separated from each other allowing them to bypass stop locks on a closure neck. Upper portion 106 has centrally oriented opening 114. Middle portion 104 has helical thread 118 depending from an inner annular surface thereof. Opening 114 is centrally oriented within upper portion 106.

Figure 6:
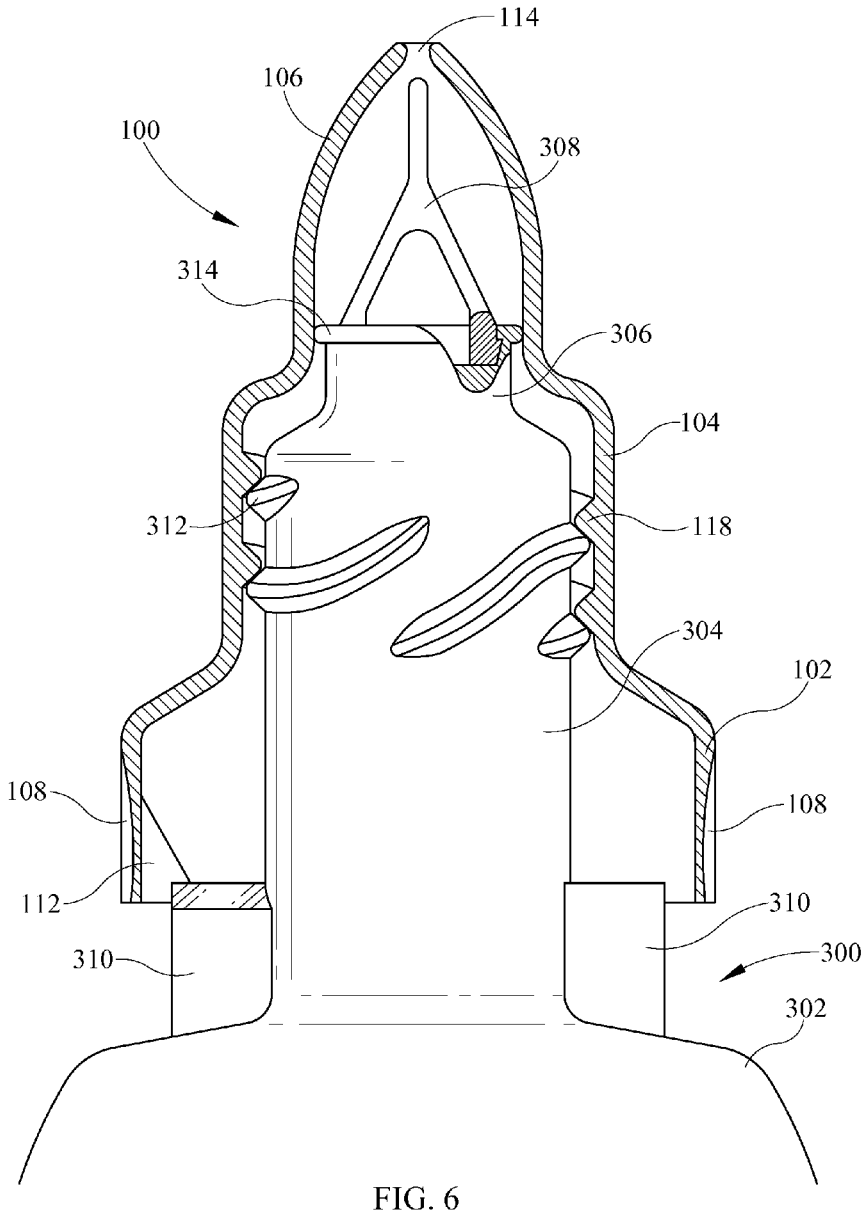
FIG. 6 is a cross-sectional view of the closure of the closure of FIG. 1 in an open position about the container neck of FIG. 3.

FIG. 6 shows closure 100 in an open position on container 300. Closure 100 shows rotational stop lugs 112 cooperating with stop locks 310 inhibiting the removal of closure 100 from container 300. On an external annular surface of lower portion 102 are squeeze guides 108 substantially opposite stop lugs 112. Upper portion 106 has opening 114. Middle portion 104 has helical thread 118 depending from an inner annular surface thereof cooperating with helical thread 312 depending from an outer annular surface of lower container neck portion 304. Upper neck portion 306 has a central opening in the top circumscribed with sealing bead 314 cooperating with an inner annular surface of upper portion 106 forming a seal there between. Sealing post 308 depends upward from the central opening in upper neck portion 306 and is spatially removed form opening 114 allowing contents of container body 302 to pass there through.

Figure 7:
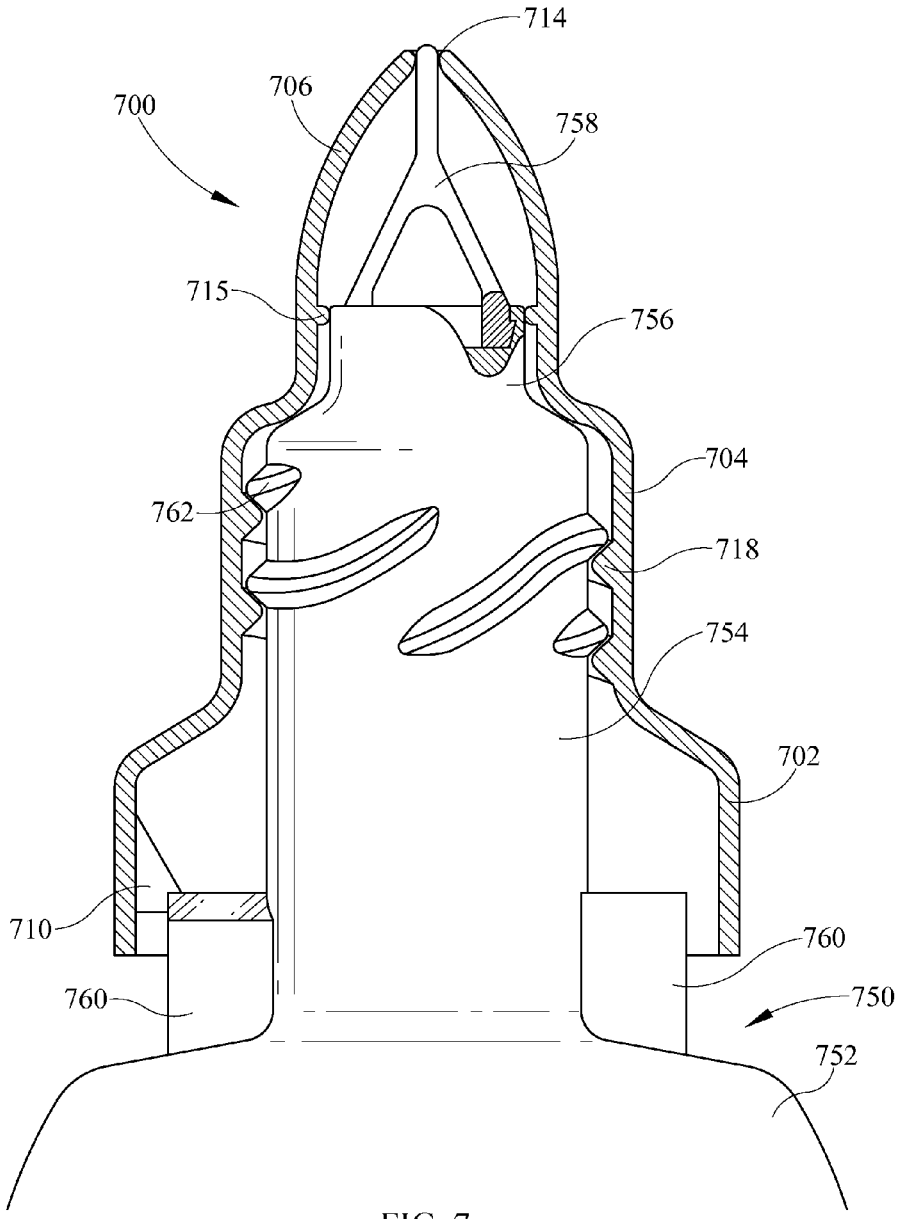
FIG. 7 is a cross-sectional view of the closure of the closure of FIG. 1 in a closed position about the container neck of FIG. 3.

FIG. 7 shows closure 700 in a closed or sealing position on container 750. Closure 700 shows child resistant lugs 710 cooperating with stop locks 760 inhibiting the removal of closure 700 from container 750. In order for closure 700 to be removed from container 750, squeeze guides need be pressed as shown in FIG. 3 releasing child resistant lugs 710 from stop locks 760. Upper portion 706 has opening 714. Middle portion 704 has helical thread 718 depending from an inner annular surface thereof cooperating with helical thread 762 depending from an outer annular surface of lower container neck portion 754. Upper neck portion 756 has a central opening in the top and sealing bead 715 forming a seal on an outer annular surface thereof. Sealing bead 715 depends from an inner annular surface of upper portion 706 of closure 700 forming a seal with upper neck portion 756. Sealing post 758 depends upward from the central opening in upper neck portion 756 and is plugging opening 714 sealing the contents of container body 752 in container 750 and closure 700.

Figure 8:
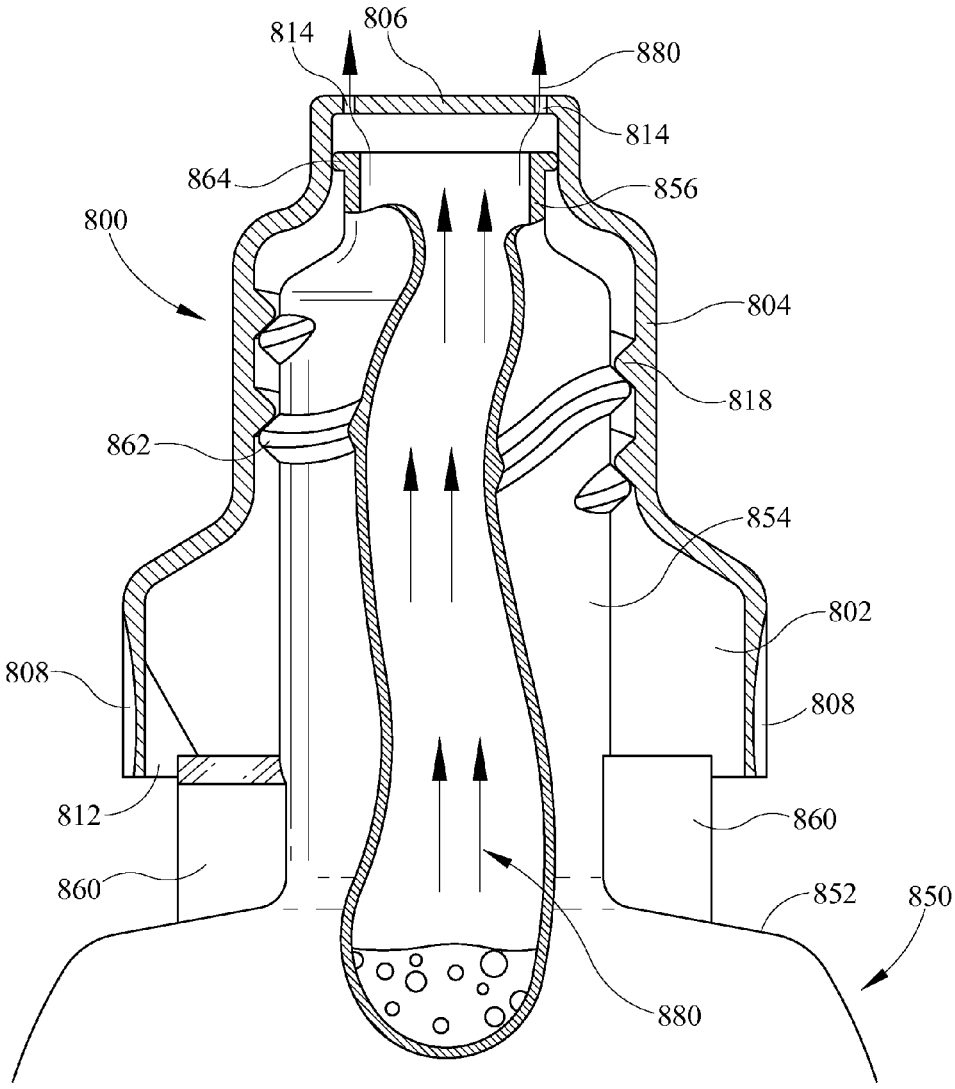
FIG. 8 is a cross-sectional view of an alternative embodiment of the closure of the of the present invention in an open position about an alternative embodiment of a container neck.

FIG. 8 shows closure 800 in an open position on container 850. Closure 800 and container 850 are of dispensing configuration designed to release evolved gases from a material contained in closure body 852. Closure 800 shows rotational stop lugs 812 cooperating with stop locks 860 inhibiting the removal of closure 800 from container 850. On an external annular surface of lower portion 802 are squeeze guides 808 substantially opposite stop lugs 812. Upper portion 806 has openings 814. Middle portion 804 has helical thread 818 depending from an inner annular surface thereof cooperating with helical thread 862 depending from an outer annular surface of lower container neck portion 854. Upper neck portion 856 has a central opening in the top circumscribed with sealing bead 864 cooperating with an inner annular surface of upper portion 806 forming a seal there between. Gas or fume flow 880 shows the release path of the fumes from container body 852 to the ambient environment.

Figure 9:
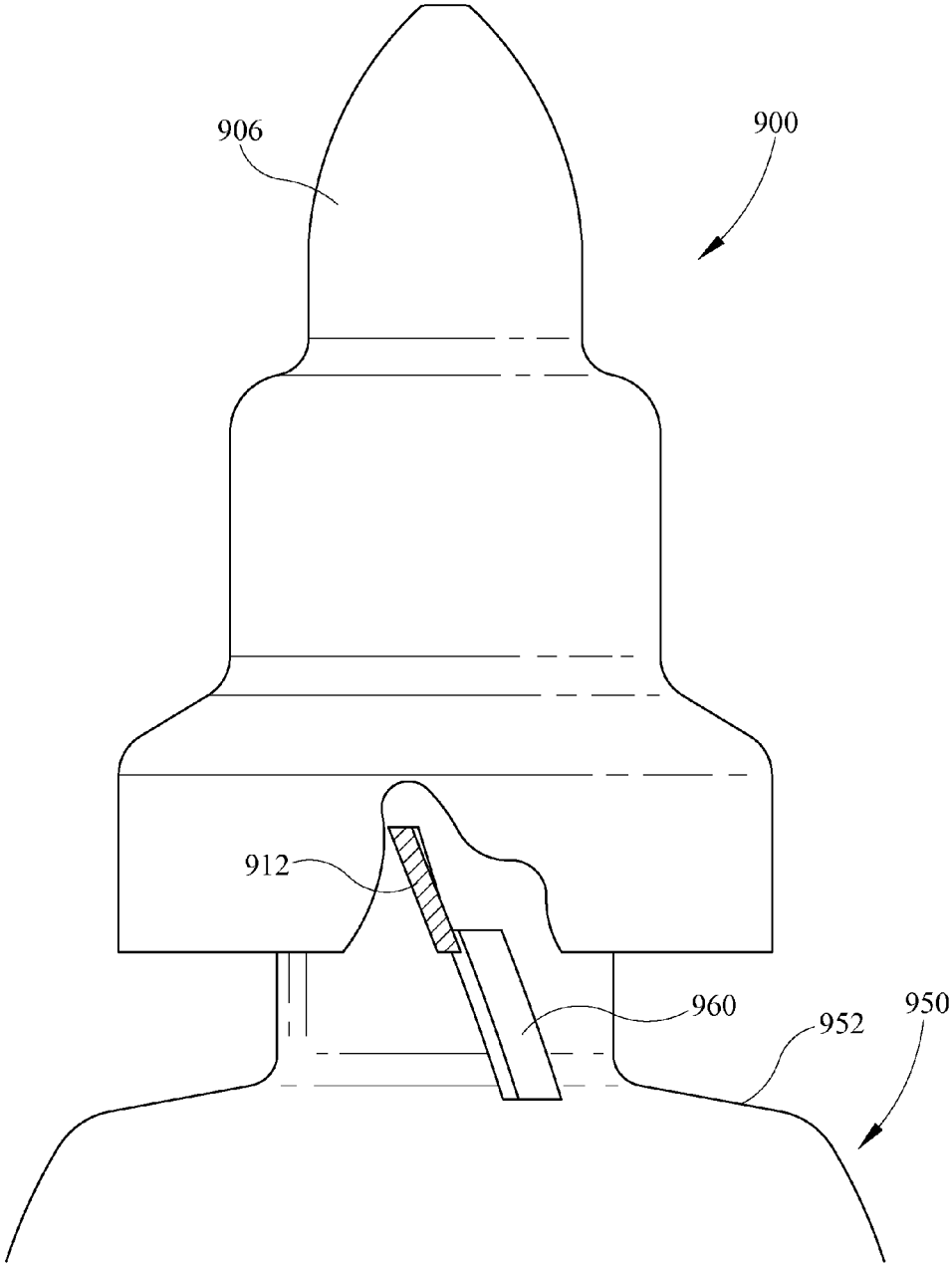
FIG. 9 is a sectional view of an alternative embodiment of a closure having lugs cooperating with lugs on a container neck.

FIG. 9 shows closure lug 921 and stop lock 960 having an angle with respect to the axis of container 950 having body 952 and closure 900 having upper portion 906. This angular relationship improves the bite or resistance to a rotational removing force placed on closure 900.

Figure 10:
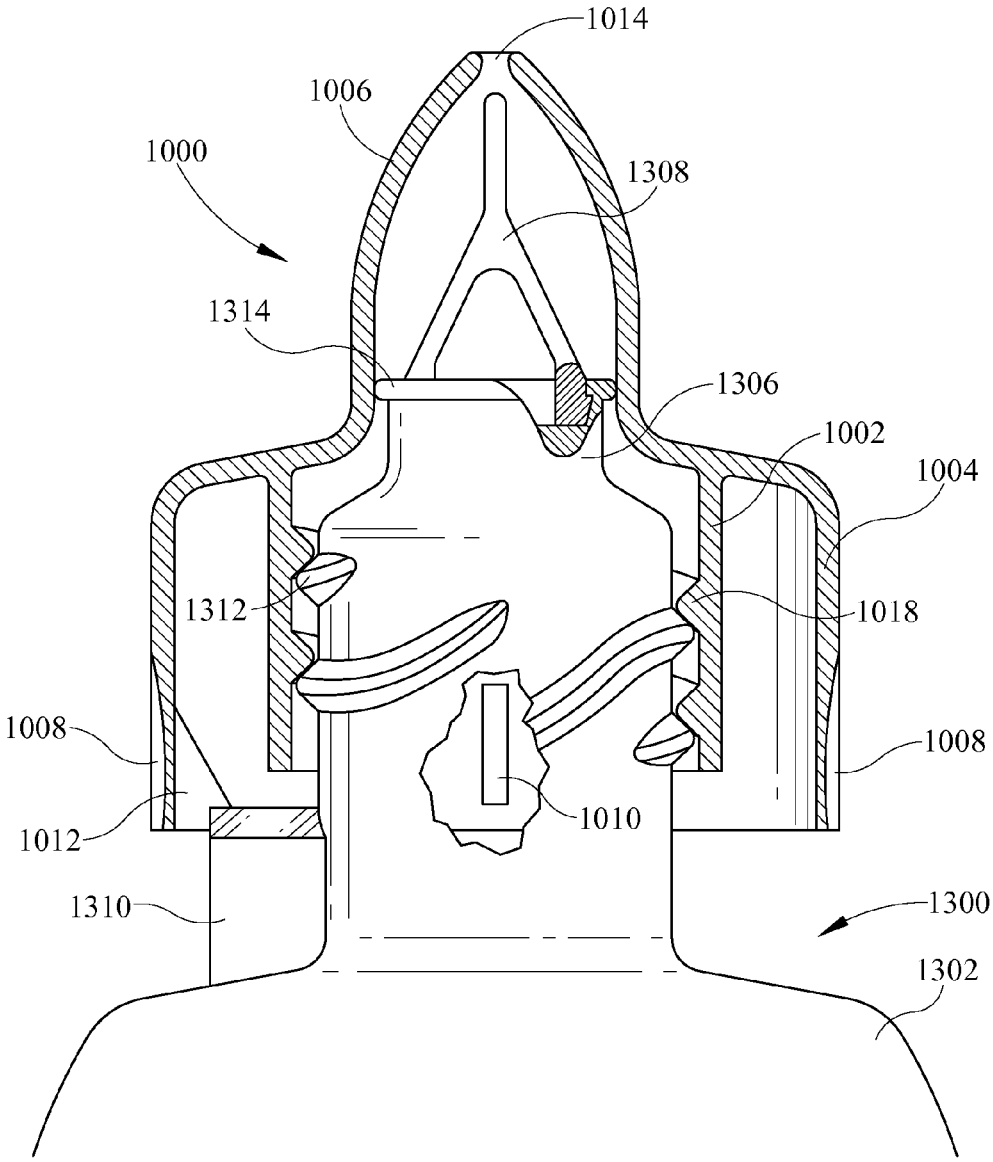
FIG. 10 is a cross-sectional view of an alternative embodiment of a closure in an open position about a container neck.

FIG. 10 shows double wall closure 1000 in an open position on container 1300. Outer wall 1004 and inner wall 1002 are joined with an extension of upper portion 1006. Closure 1000 shows rotational stop lug 1012 cooperating with stop lock 1310 inhibiting the removal of closure 1000 from container 1300 thus functioning as an off stop. On an external annular surface of lower portion of outer wall 1004 are squeeze guides 1008, one of which is substantially opposite stop lug 1012. At about 90° from stop lug 1012 is stop lug 1010 which cooperates with container stop lock 1310 upon the sealing of closure 1000 upon container 1300. In a sealed configuration, applying a squeezing force on squeeze guides 1008 deforms a lower portion of outer wall 1004 separating stop lug 1010 from stop lock 1310 thus providing a child resistant feature to closure 1000. Upper portion 1006 has opening 1014. Inner wall portion 1002 has helical thread 1018 depending from an inner annular surface thereof cooperating with helical thread 1312 depending from an outer annular surface of container neck portion 1306. The upper portion of container neck 1306 has a central opening in the top circumscribed with sealing bead 1314 cooperating with an inner annular surface of upper portion 1006 forming a seal there between. Sealing post 1308 depends upward from the central opening in upper neck portion 1306 and is spatially removed from opening 1014 allowing contents of container body 1302 to pass there through. Even though this embodiment of double wall closure 1000 shows only two stop lugs 1012 and 1010 for cooperation with one stop lock 1310 it is to be understood that a double wall embodiment may have more stop lugs, preferably four at about 90° intervals, and container 1300 may have more stop locks, preferably 2 at about 180° intervals.

Figure 11:
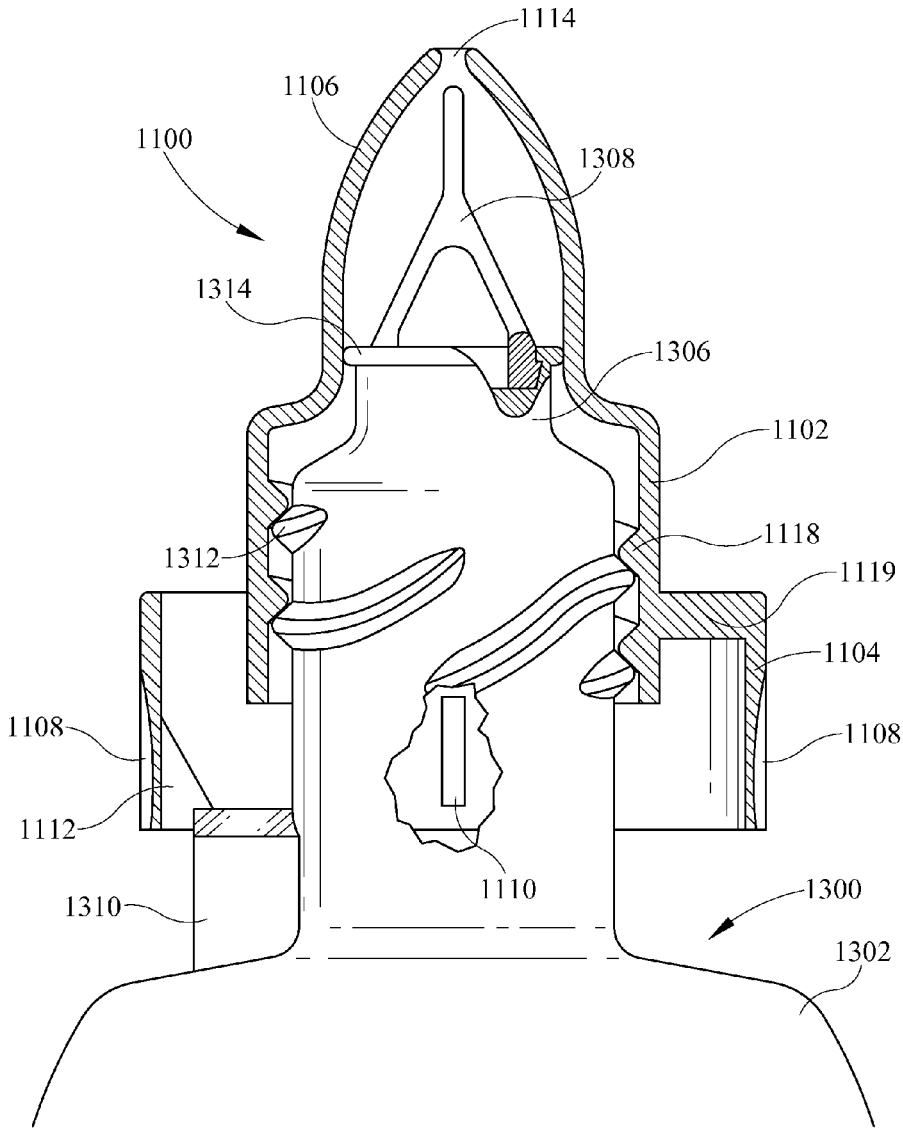
FIG. 11 is a cross-sectional view of yet another embodiment of a closure in an open position about a container neck.

FIG. 11 shows double wall closure 1100 in an open position on container 1300. Outer wall 1104 and inner wall 1102 are joined with flanges 1119 spatially arranged about the upper edge of outer wall 1104. Closure 1100 shows rotational stop lug 1112 cooperating with stop lock 1310 inhibiting the removal of closure 1100 from container 1300 thus functioning as an off stop. On an external annular surface of lower wall portion of outer wall 1104 are squeeze guides 1108, one of which is substantially opposite stop lug 1112. At about 90° from stop lug 1112 is stop lug 1110 which cooperates with container stop lock 1310 upon the sealing of closure 1100 upon container 1300. In a sealed configuration, applying a squeezing force on squeeze guides 1108 deforms a lower portion of outer wall 1104 separating stop lug 1110 from stop lock 1310 thus providing a child resistant feature to closure 1100. Upper portion 1106 has opening 1114. Inner wall portion 1102 has helical thread 1118 depending from an inner annular surface thereof cooperating with helical thread 1312 depending from an outer annular surface of container neck portion 1306. The upper portion of container neck 1306 has a central opening in the top circumscribed with sealing bead 1314 cooperating with an inner annular surface of upper portion 1106 forming a seal there between. Sealing post 1308 depends upward from the central opening in upper neck portion 1306 and is spatially removed from opening 1114 allowing contents of container body 1302 to pass there through. Even though this embodiment of double wall closure 1100 shows only two stop lugs 1112 and 1110 for cooperation with one stop lock 1310 it is to be understood that this or other double wall or single wall embodiments may have more stop lugs, preferably four at about 90° intervals, and container 1300 may have more stop locks, preferably 2 at about 180° intervals.

The foregoing detailed description is given primarily for clearness of understanding and no unnecessary limitations are to be understood therefrom and modifications will become obvious to those skilled in the art upon reading the disclosure and may be made without departing from the spirit of the invention and scope of the appended claims.

The invention claimed is:

1. A dispensing closure comprising:

a dispensing closure having at least one dispensing aperture defined by a top wall of said closure, said closure threadably engagable with a container, said container having a container neck defining an opening surrounded by a rim, a pair of opposing stop locks projecting from said container neck and positioned at about 180° from each other;

said closure having a deformable outermost skirt depending from said top wall, said outermost skirt having an interior surface and an exterior surface;

at least two rotational stop lugs spaced about said interior surface of said outermost skirt at about 180° from each other, and at least two child resistant lugs projecting from said interior surface of said outermost skirt and spaced about said interior surface of said outermost skirt at about 90° from each of said rotational stop lugs;

each of said stop lugs positioned at a first radial distance and each of said child resistant lugs positioned at a second radial distance, wherein said first radial distance is substantially the same as said second radial distance;

each of said rotational stop lugs positioned proximate a lower edge of said outermost skirt and each of said child resistant lugs are offset at a distance away from said lower edge of said outermost skirt said at least two child resistant lugs operably engaging said stop locks of said container neck upon initial counterclockwise rotation of said closure on said container and wherein inward pressure adjacent each of said rotational stop lugs causes said outermost skirt to deflect allowing each of said child resistant lugs to override said stop locks and, each of said rotational stop lugs operably engage said stop locks of said container to prevent continued counterclockwise rotation of said closure on said container and further inhibits removal of said closure from said container since each of said rotational stop lugs do not release contact with said stop locks when inward pressure is applied to said outermost skirt adjacent each of said child resistant lugs; and said dispensing closure is non-removable.

2. The dispensing closure of claim 1 wherein each one of said two rotational stop lugs project further from said interior surface of said outermost skirt than each one of said two child resistant lugs.

3. The dispensing closure of claim 1 wherein said exterior surface of said outermost skirt has a squeeze guide proximate each of said at least two rotational stop lugs.

4. The dispensing closure of claim 1 wherein said closure thread projects from said interior surface of said outermost skirt.

5. The dispensing closure of claim 1 wherein said top wall is dome like in shape.

6. The dispensing closure of claim 1 wherein said top wall has a plurality of said at least one dispensing apertures.

7. The dispensing closure of claim 1 is a single wall closure.

8. The dispensing closure of claim 1 wherein said outermost skirt is an outer wall of a double wall closure.

9. The dispensing closure of claim 1 further including a sealing post operably engaging said at least one dispensing aperture of said top wall.

10. The dispensing closure of claim 1 wherein said closure thread is in a cooperating position with a container thread depending from an outer annular surface of said container neck at least until such time that said at least two rotational stop lugs abut said pair of opposing stop locks of said container neck and, said pair of opposing stop locks of said container neck are positioned so that said at least two child resistant lugs are sufficiently adjacent a locking side of said pair of opposing stop locks when said closure is in a tightened position on said container neck so that a sealing post connected to an upper end of said container neck seals said at least one dispensing aperture in said closure and said sealing post seals said at least one dispensing aperture during initial counterclockwise rotation of said closure at least until said at least two child resistant lugs are oriented to make initial contact with said pair of opposing stop locks of said container neck and, said sealing post is withdrawn from said at least one dispensing aperture when said at least two rotational stop lugs abut said pair of opposing stop locks.

11. A closure and container combination comprising:

a closure being a non-removable closure threadably engaging a container neck of a container, said container neck projecting at least one stop lock;

said closure having a top wall with at least one opening therein, a deformable outermost skirt depending from said top wall; and an interior surface of said outermost skirt having at least one child resistant lug and at least one rotational stop lug projecting inwardly therefrom at an annular position having substantially the same radial distance from the central axis of said closure, said at least one rotational stop lug positioned more proximate a lower edge of said outermost skirt than each one of said at least one child resistant lugs, a squeeze guide positioned on an outside surface of said closure outermost skirt adjacent each of said at least one rotational stops, said at least one child resistant lug operably engaging said at least one stop lock of said container neck upon initial counterclockwise rotation of said closure on said container and wherein said at least one child resistant lug overrides at least one stop lock of said container neck when a squeezing force is placed on said squeeze guide of said outermost skirt, said at least one rotational stop lug operably engages said at least one stop lock of said container neck to prevent continued counterclockwise rotation of said closure on said container and further inhibits removal of said closure from said container since said at least one rotational stop lug remains in contact with said at least one stop lock of said container neck when said squeezing force is placed on said outermost skirt adjacent said at least one child resistant lug.

12. The closure and container combination of claim 11 wherein said at least one child resistant lug and said at least one rotational stop lug are spaced less than 180° from each other about said interior surface of said outermost skirt.

13. The closure and container combination of claim 11 wherein said outermost skirt projects two of said at least one child resistant lugs spaced at about 180° from each other and two of said at least one rotational stop lugs spaced about 90° from each of said child resistant lugs.

14. The closure and container combination of claim 11 wherein said at least one rotational stop lug projects further from said interior surface of said outermost skirt than said at least one child resistant lug.

15. The closure and container combination of claim 11 wherein said threads of said closure project from said interior surface of said outermost skirt.

16. The closure and container combination of claim 11 wherein said outermost skirt is an outer wall of a double wall closure.

17. The closure and container combination of claim 16 wherein said closure thread projects from an interior surface of an inner wall of said double wall closure.

18. The closure and container combination of claim 11 wherein said top wall has a plurality of said at least one openings.

19. The closure and container combination of claim 11 wherein said closure thread is in a cooperating position with said container thread depending from an outer annular surface of said container neck at least until such time that said at least one rotational stop lug abuts said at least one stop lock of said container neck and, said at least one stop lock of said container neck is positioned so that said at least one child resistant lug is sufficiently adjacent a locking side of said at least one stop lock when said closure is in a tightened position on said container neck so that a sealing post connected to an upper end of said container neck seals said at least one opening in said closure and said sealing post seals said at least one opening during initial counterclockwise rotation of said closure at least until said at least one child resistant lug is oriented to make initial contact with said at least one stop lock of said container neck and, said sealing post is withdrawn from said at least one opening when said at least one rotational stop lug abuts said at least one stop lock of said container neck.

20. A non-removable dispensing closure and container combination comprising:

a dispensing closure threadably engaging a container, said closure including a cap body with a top wall wherein said top wall defines a dispensing orifice therethrough, and a deformable annular outermost skirt depending from said top wall, said annular outermost skirt positioned at a radial distance from the central axis of said closure and includes at least one child resistant lug and at least one rotational stop lug projecting therefrom at said radial distance, said at least one rotational stop lug positioned proximate a lower edge of said outermost skirt and said at least one child resistant lug is offset at a distance away from said lower edge of said outermost skirt;

said annular outermost skirt having said thread projecting therefrom; and said container including a neck defining an opening surrounded by a rim, said neck having at least one stop lock formed thereon, said at least one stop lock operably engaging said at least one child resistant lug upon initial counterclockwise rotation of said closure on said container and wherein inward pressure on said deformable outermost skirt adjacent said at least one rotational stop lug causes said annular outermost skirt to deflect allowing said at least one child resistant lug to override said at least one stop lock of said container neck, and wherein said at least one rotational stop lug operably engage said at least one stop lock of said container neck to prevent continued counterclockwise rotation of said closure on said container and further inhibits removal of said closure from said container since said at least one rotational lug remains engaged with said at least one stop lock when inward pressure is applied and deforms said outermost skirt.

* * * * *

UNITED STATES PATENT AND TRADEMARK OFFICE

CERTIFICATE OF CORRECTION

PATENT NO. : 7,828,166 B1
APPLICATION NO. : 11/381407
DATED : November 9, 2010
INVENTOR(S) : William Douglas Sprick It is certified that error appears in the above-identified patent and that said Letters Patent is hereby corrected as shown below:

Column 2, Line 23: delete “of the closure” after “of the closure”
Column 2, Line 29: delete “of the closure” after “of the closure”
Column 2, Line 31: delete “of the closure” after “of the closure”
Column 2, Line 34: delete “of the closure” after “of the closure”
Column 2, Line 38: delete “of the” after “of the”
Column 3, Line 27: replace “child resistant lugs 110” with --the pair of stop locks 310--
Column 4, Line 15: replace “form” with --from--
Column 4, Line 22: replace “FIG. 3” with --FIG. 5--

Signed and Sealed this
Seventeenth Day of April, 2012

David J. Kappos

David J. Kappos
*Director of the United States Patent and Trademark Office*